United States Patent [19]

Sidaway et al.

[11] 4,296,891

[45] Oct. 27, 1981

[54] EXPANDABLE CORE FOR ROLLS OF TUBING

[75] Inventors: H. John Sidaway, Findlay, Ohio; Maynard Good, Elkhart, Ind.

[73] Assignee: Hancor, Inc., Findlay, Ohio

[21] Appl. No.: 118,085

[22] Filed: Feb. 4, 1980

[51] Int. Cl.[3] ..... B65H 75/24; B65H 75/40

[52] U.S. Cl. ..... 242/110; 242/86.5 R

[58] Field of Search ..... 242/86.5 R, 86.8, 99, 242/110, 110.1, 115; 414/24.6, 621, 703, 911, 684, 1 HA

[56] References Cited

U.S. PATENT DOCUMENTS

| | | | |
|---|---|---|---|
| 1,573,183 | 2/1926 | Mehlum | 242/110 |
| 3,326,495 | 6/1967 | De Bruyn | 242/129 |
| 3,968,940 | 7/1976 | Godbersen | 414/24.6 |
| 4,071,203 | 1/1978 | Sneed et al. | 242/86.6 |
| 4,095,706 | 6/1978 | Schwein et al. | 414/24.6 |

OTHER PUBLICATIONS

Drainage Contractor, vol. 4, No. 1, p. 90, (1978).
Drainage Contractor, vol. 5, No. 1, pp. 12–13, (1979).

*Primary Examiner*—Leonard D. Christian
*Attorney, Agent, or Firm*—Fay & Sharpe

[57] ABSTRACT

An expandable core for handling and holding rolls of tubing. The core is comprised of support members connected to each other or a base extending along the longitudinal axis of the core by connecting links. The connecting links are pivotally attached at their terminal ends to the support members or the base rod to allow movement about a pivot assembly. Camming surfaces are mounted at the terminal ends of the support members and means for selectively expanding the core are adapted to engage the camming surface.

19 Claims, 6 Drawing Figures

FIG. 5
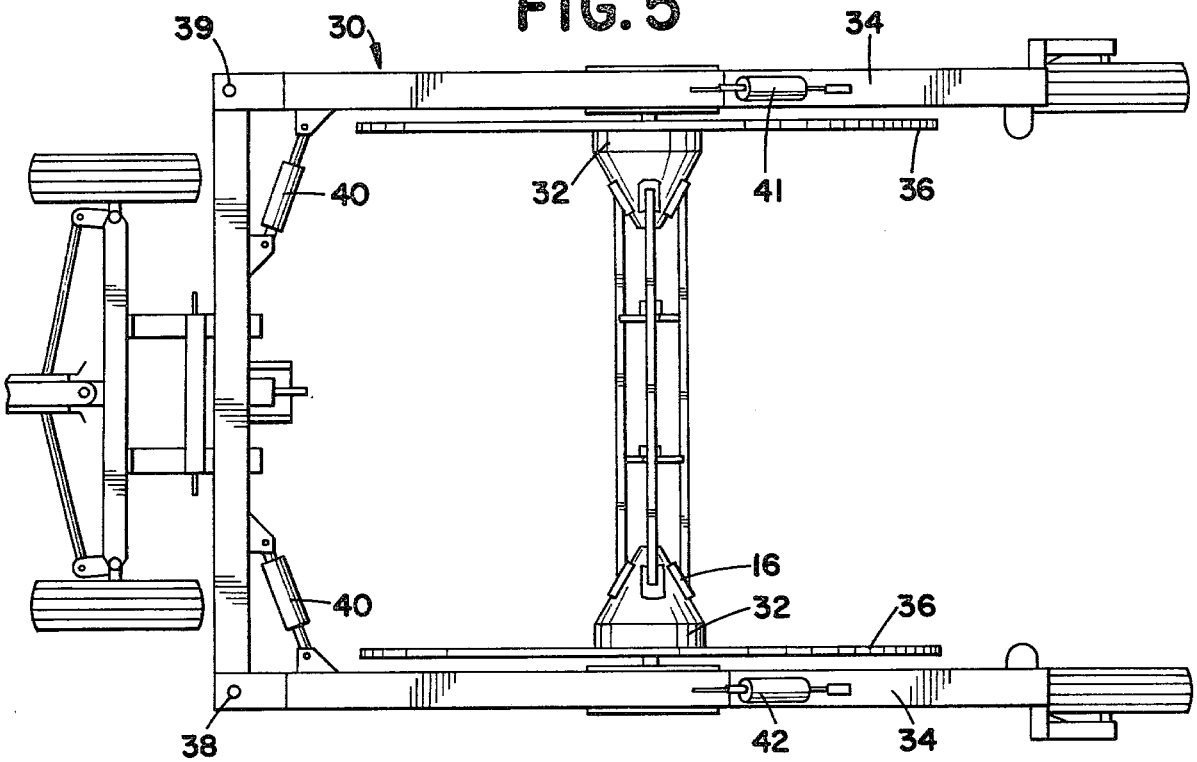
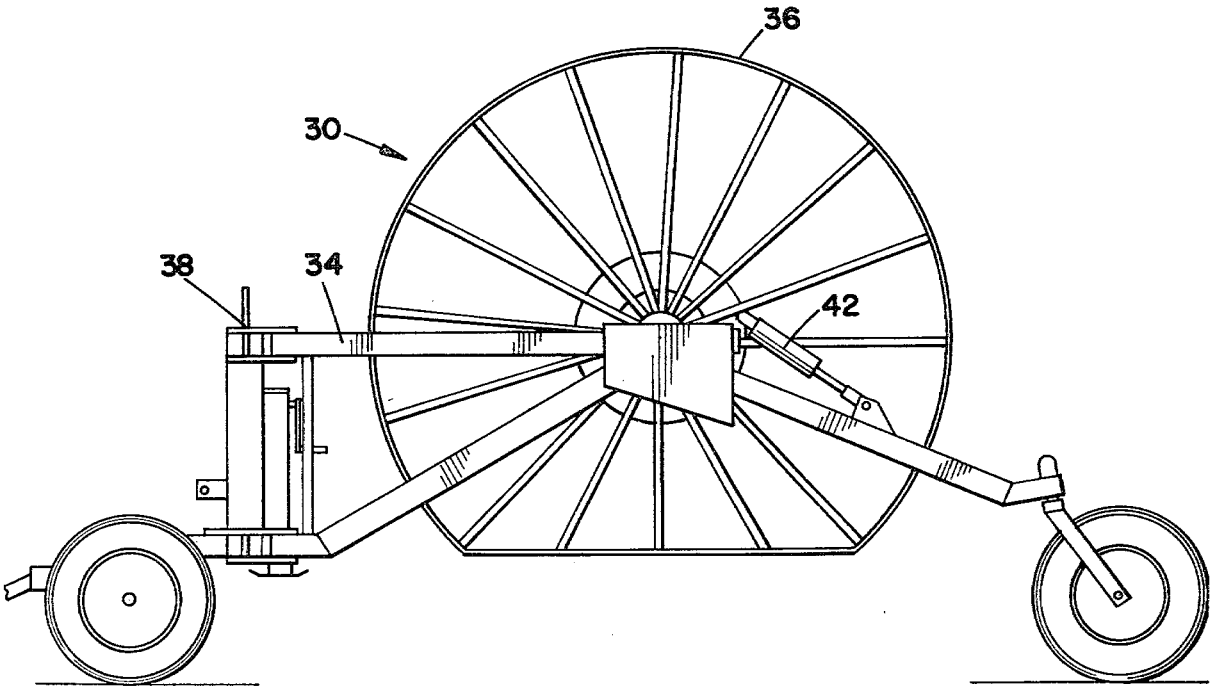
FIG. 6

EXPANDABLE CORE FOR ROLLS OF TUBING

BACKGROUND OF THE INVENTION

This invention pertains to the art of reels, cores or the like for holding tubing or wire and more particularly to an expandable, collapsible and removable core for large rolls of tubing; such as the corrugated plastic tubing used in the drainage tubing industry. However, it will be appreciated to those skilled in the art that the invention could be readily adapted for other uses or used in other environments as, for example, where similar reel devices are employed for the holding of other materials.

Conventionally, a normal roll of large tubing such as four inch corrugated tubing includes two hundred fifty feet of tubing. In recent years, the drainage contracting industry has tended towards using very large rolls of tubing, such as twenty five hundred to five thousand foot rolls, to eliminate the inefficiencies of handling smaller coils during transport and stringing operations. The ultimate size of these large rolls is limited only by the bulk and weight that can be handled by machinery and supported by existing ground conditions at field installations.

One present method used to handle and hold large rolls is to construct huge steel reels on which the tubing is wrapped in the manufacture's plant. The large reel with the tubing wrapped upon it is treated as a unit for shipping and stringing operations. Once the tubing is used, the steel reels must be retrieved and returned to the plant, where a large inventory must be maintained for production. Also, the size and weight of these large tubing and reel units is such that only excellent ground conditions will permit their use in the field or the units may become bogged down or stuck. This type of unit is shown in *Drainage Contractor* magazine, Vol. 4, No. 1 at page 90 (1978).

Another typical prior art reel is comprised of a piece of eighteen inch steel corrugated pipe for use as the core of a large roll of corrugated plastic tubing. Again, a disadvantage of this device is that it must be retrieved by the manufacturer once the roll is used. Also, the ends of the reels must be reinforced to protect them from damages incurred from the heavy machinery which must necessarily be used for their handling. In addition, hooks must be installed on the pipe to use as an attachment ring for restraining wires for the rolls of tubing. This device is further disclosed in *Drainage Contractor*, Vol. 5, No. 1, at pages 12–13 (1979).

The present invention contemplates a new and improved device which overcomes all of the above referred to problems and others to provide a new removable core which is simple in design, economical to manufacture, readily adaptable to a plurality of uses with tubing, wire, or the like having a variety of dimensional characteristics, easy to install, easy to remove and which provides improved ease of transportation and installation.

BRIEF SUMMARY OF THE INVENTION

In accordance with the present invention, there is provided an expandable and collapsible core particularly suited for holding large rolls of tubing. The new core is generally comprised of a plurality of support members in cooperative relationship with connecting links between the support members or between the support members and a base rod extending along the longitudinal axis of the core. The connecting links are pivotally connected at their terminal ends to the support members or the base rod. The support members have camming surfaces at their terminal ends which are adapted to engage a power means for selectively expanding the diameter of the core.

In accordance with another aspect of the present invention, a sliding sleeve is mounted on the base rod and pivotally connected to the connecting links.

In accordance with a further aspect of the present invention, the connecting links are pivotally connected at a midpoint between the support members or between the base rods and support members.

In accordance with another more limited aspect of the present invention, the camming surfaces comprise planar panels adapted to conformedly engage the power means.

In accordance with yet a further aspect of the invention, a cart having conical members adapted to engage the camming surfaces for powered advancement against the camming surfaces, is provided.

One benefit obtained by the use of the present invention is an expandable, collapsible and removable reel for use with a variety of diameter tubing.

Another benefit obtained from the present invention is an expandable core which substantially reduces the problems of transportation, handling and retrieval from field use inherent with prior art cores.

A further benefit of the present invention is an expandable core which may be inserted into large rolls of tubing where the center of the tubing roll has deformed to an out-of-round state.

Other benefits and advantages for the subject new expandable core will become apparent to those skilled in the art upon a reading and understanding of the specification.

BRIEF DESCRIPTION OF THE DRAWINGS

The invention may take physical form in certain parts and arrangement of parts, the preferred and alternative embodiments of which will be described in detail in the specification and illustrated in the accompanying drawings which form a part hereof and wherein:

FIG. 5 is a perspective view of an expandable core mounted on a cart used in the transportation and handling of the core and having conical members adapted for engagement to the core;

FIG. 6 is a side perspective view of the cart with the expandable core mounted thereon.

DETAILED DESCRIPTION OF THE INVENTION

Figure 1:
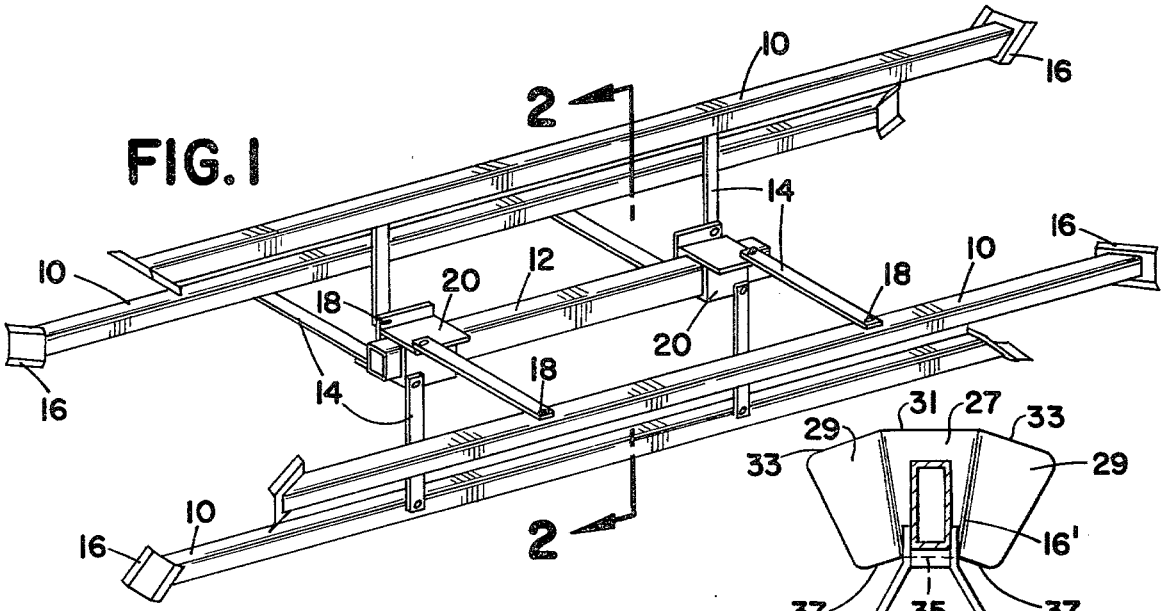
FIG. 1 is a perspective view of an expandable core formed in accordance with the present invention showing it in an expanded position.

Referring now to the drawings wherein the showings are for purposes of illustrating the preferred and alternative embodiments of the invention only and not for purposes of limiting same, FIG. 1 shows an expandable core device comprised of a plurality of support members 10, a base rod 12, a plurality of connecting links 14 and camming or follower surfaces 16 at the terminal ends of support members 10. The expandable core may be constructed of any lightweight durable metallic material, but preferably commercially available lightweight steel is used.

Figure 2:
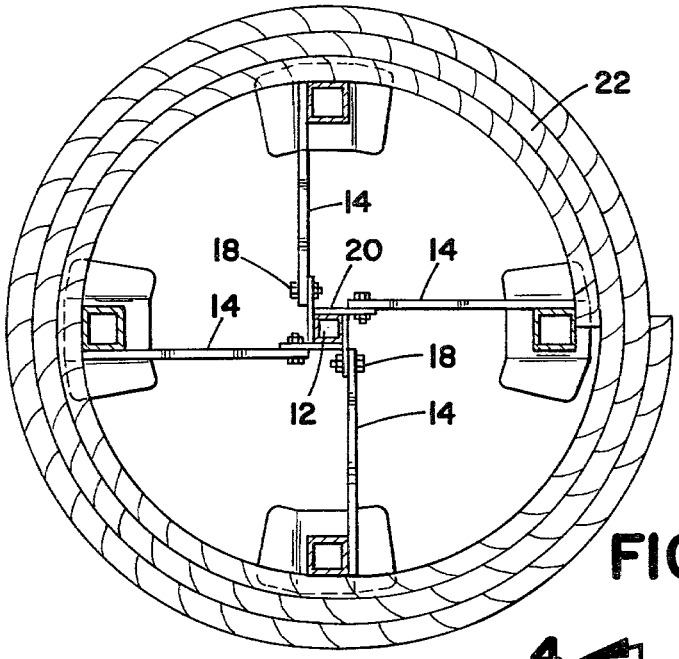
FIG. 2 is a cross-sectional view taken along line 2—2 of FIG. 1 with the inclusion of a roll of tubing shown wrapped on the core.

More specifically and with reference to FIGS. 1 and 2, support members 10 have a generally square cross-sectional configuration but are hollow for purposes of maintaining a light weight. Support members 10 are radially outward from base rod 12 which extends along the longitudinal axis of the expandable core. Base rod 12 is of similar construction configuration to support members 10 but has a lesser longitudinal length. Connecting links 14 extend between the support members 10 and the base rod 12. Links 14 are normally of solid metallic construction and have pin holes drilled through their terminal end portions. The links 14 have hinge or pivotal connections at their terminal ends and are pivotally connected to support member 10 through conventional pivot pin assemblies 18. The connecting links 14 are further operatively connected to base rod 12 through pivotal attachment to sliding sleeve 20. The sleeve 20 is loosely mounted on base rod 12 to allow movement of sleeve 20 along the base rod 12.

An alternative embodiment of the present invention has a second connecting link pivotally attached directly to base rod 12 at its one end and pivotally attached at its other end to the first connecting link 14. A sliding sleeve 20 would not be used in this particular embodiment.

With particular reference to FIG. 2, tubing 22 is shown wrapped around the expandable core in an abutting relationship with support members 10.

Figure 4:
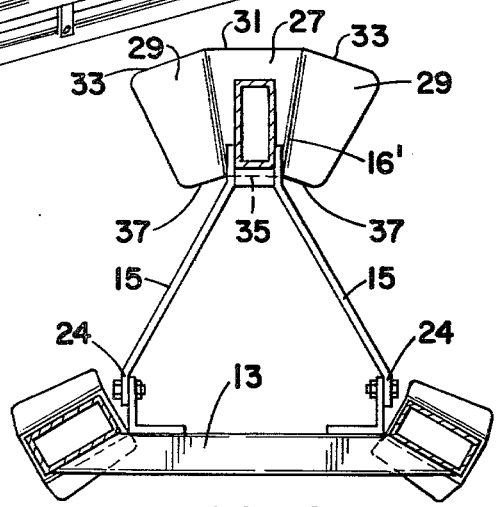
FIG. 4 is a cross-sectional view taken along line 4—4 of FIG. 3.
Figure 3:
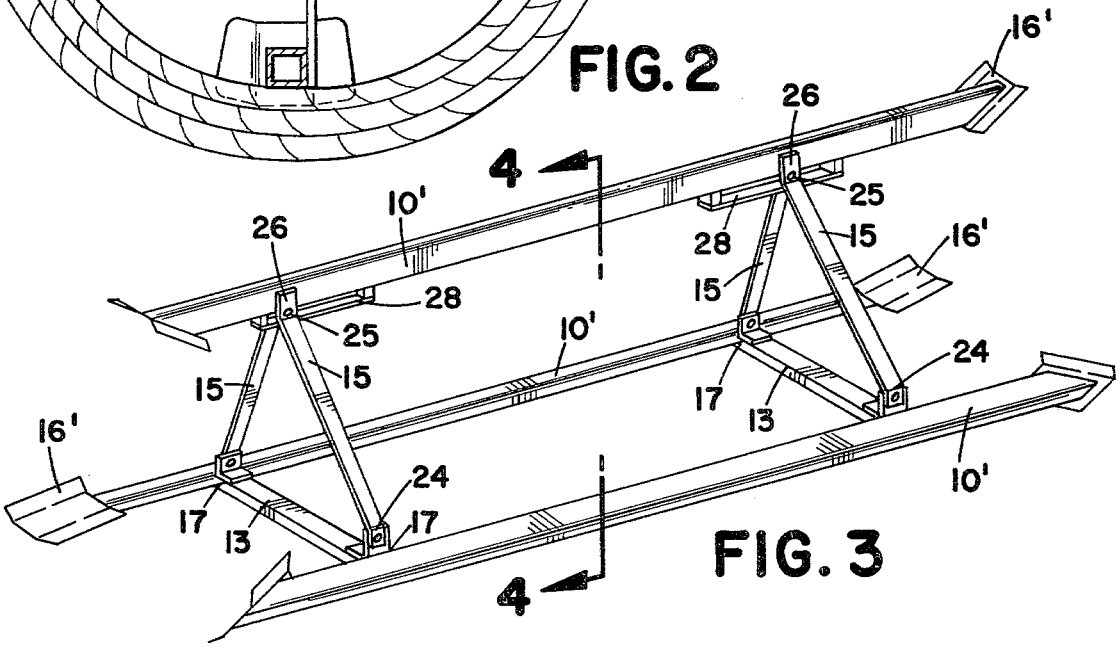
FIG. 3 is a perspective view of an expandable core formed in accordance with an alternative embodiment of the present invention.

With particular reference to FIGS. 3 and 4 an alternative embodiment of the present invention is shown comprising a plurality of support members 10', connecting links 13, 15, and camming or follower surfaces 16'. In this embodiment only three support members are preferably utilized. A base rod is not required. Connecting links 13 extending between support members 10' are fixedly attached at terminal ends 17 to the support members 10'. Connecting links 15 are pivotally attached at their one end 24 to support members 10' and connecting link 13 and are pivotally affixed with pin assemblies 25 at their opposed ends 26 in a slot 28 for purposes of allowing movement of opposed end 26 in direction substantially parallel to support members 10'.

Alternatively to slot 28 an additional connecting link could be pivotally attached between connecting links 15 and support rod 10'.

With particular reference to FIG. 4, camming surfaces 16' are shown comprising a central planar panel 27 and opposing side planar panels 29. Central panel 27 and side panels 29 are disposed radially inwardly from the outer terminals ends of the panels 31, 33 towards the inner terminal ends of the panels 35, 37. The opposing side panels 29 are further disposed latitudinally radially inwardly from the central planar panel 27.

OPERATION

With particular attention to FIGS. 1, 3, and 5 the improved operational characteristics of the new expandable core will be specifically discussed.

When the core is in its collapsed state it is inserted into the center of a large roll of tubing. Where the center of the tubing roll has a generally round cross-sectional configuration, the embodiment of the expandable core shown in FIGS. 1 and 2 is preferably used. Where the center of the tubing roll has an out-of-round cross-sectional configuration, the embodiment of the expandable core as shown in FIGS. 3 and 4 is preferably used. After the core has been inserted, expansion against the roll of tubing is effected through the use of cart 30 shown in FIGS. 5 and 6. Cart 30 has conical members 32 which are specifically designed for association with the camming surfaces 16 or 16'. Conical members 32 are rotatably affixed to the side frames 34 of cart 30. Adjacent conical members 32, tubing retaining guards 36 are mounted on side frames 34. Side frames 34 pivot about hinge assemblies 38, 39. Pivotal movement of frames 34 is preferably powered by hydraulic piston assemblies 40, but any like power means could be advantageously utilized.

Conical members 32 are first positioned substantially adjacent the camming surfaces 16 or 16' of the invention. The side frames 34 of the cart 30 are constructed so that they may swing out for ease in arranging the conical members 32 in their proper position. After the conical members 32 are substantially adjacent the camming surfaces 16 or 16' the side frames 34 of the cart 30 are pivoted towards the core by piston assemblies 40 thereby forcing the conical members 32 against the camming surfaces 16 or 16'. As the conical members 32 are further advanced, the support members 10 or 10' are further forced radially outwardly to a close abutting relationship with the tubing. Support members 10 or 10' may be forced radially outwardly until the connecting links 14 or 15 are disposed in a plane generally perpendicular to the longitudinal axis of the core but preferably a tight abutting relationship with the tubing is effected before full expansion.

Camming surfaces 16 or 16' are particularly constructed to closely engage the conical members 32. In the preferred embodiment each of the camming surfaces 16 or 16' is comprised of three planar sections, a central planar panel 27 and two opposed side planar panels 29 which are disposed to conformedly engage conical members 32.

After the core has been tightly fitted to the roll of the tubing the roll may be easily transported on the cart 30. The roll is lifted from the ground by piston assemblies 42. Conical members 32 rotate to allow rotation of the roll for removal and stringing of the tubing. After the tubing on the roll has been expended the conical members 32 may be withdrawn from the core and the core removed from the cart 30. The core is then free to be inserted into another roll of tubing which in turn will be then mounted on the cart 30.

The invention has been described with reference to the preferred embodiment. Obviously, moderations and alterations will occur to others upon the reading and understanding of the specification. It is our intention to include all such modifications and alterations as far as they come within the scope of the appended claims or the equivalent thereof.

Having thus described our invention, we now claim:

1. An expandable reel for rolls of tubing comprising a base rod extending generally along the longitudinal axis of said reel; a plurality of support members disposed radially outwardly from said base rod and extending substantially parallel thereto; a plurality of connecting links extending between and operatively connecting said support members and said base rod, said links hingedly connected to a first point along the length of said links for pivotal movement about a hinge; camming surfaces at the terminal ends of said support members; and, means for selectively expanding said reel from a first to second expanded position adapted to engage said camming surfaces.

2. The expandable reel as defined in claim 1 wherein said connecting links are hingedly connected at a second point along the length of said links to a sliding sleeve.

3. The expandable reel as defined in claim 2 wherein said sliding sleeve is mounted for movement on said base rod.

4. The expandable reel as defined in claim 1 wherein said connecting links are further hingedly connected at a point between said base rod and said support members.

5. The expandable reel as defined in claims 2 or 4 wherein the number of said support members is four.

6. The expandable reel as defined in claims 2 or 4 wherein at least two of said connecting links extend between each of said support members and said base rod.

7. The expandable reel as defined in claims 2 or 4 wherein said base rod is of a lesser length than said support members.

8. The expandable reel as defined in claims 2 or 4 wherein said camming surfaces comprise a central planar panel and opposing side planar panels.

9. The expandable reel as defined in claim 8 wherein said central planar panel and said opposing side planar panels are disposed radially inwardly from said panels outer terminal ends towards said panels inner terminal ends and said side planar panels are further disposed radially inwardly from said central planar panel.

10. The expandable reel as defined in claim 1 wherein said means for selectively expanding said reel comprises rotatable conical members mounted on the sides of a cart, said sides being pivotally mounted on the frame of said cart, said cart having power means for selectively advancing said conical members against said camming surfaces, whereby said support members are radially outwardly expanded as said conical members are further advanced against said camming surfaces.

11. An apparatus for handling tubing comprising a plurality of support members; connecting links extending between said support members and operatively connecting said support members, at least one of said links pivotally connected at a terminal end portion of said link to said support members for movement of said support members between an expanded and a collapsed position; camming surfaces at the terminal ends of said support members; and, means for selectively expanding said support members adapted to engage said camming surfaces.

12. The apparatus as defined in claim 10 wherein said connecting links are pivotally connected at one terminal end to a sliding sleeve.

13. The apparatus as defined in claim 11 wherein said connecting links are further pivotally connected at a point between said support members.

14. The apparatus as defined in claim 11 wherein at least one terminal end of said connecting links is affixed in a slot in said support members for movement of said terminal end along said slot in a direction substantially parallel to said support member whereby at least one of said support members is expanded or collapsed in association with the movement of said link terminal end along said slot.

15. The apparatus as defined in claims 12, 13, or 14 wherein the number of said support members is three.

16. The apparatus as defined in claims 12, 13, or 14 wherein at least two of said connecting links extend between said support members.

17. The apparatus as defined in claims 12, 13 and 14 wherein said camming surfaces comprise a central planar panel and opposing side planar panels.

18. The apparatus as defined in claim 17 wherein said central planar panel and said opposing side planar panels are disposed radially inwardly from said panels outer terminal ends towards said panels inner terminal ends and said side planar panels are further disposed radially inwardly from said central planar panel.

19. The apparatus as defined in claim 11 wherein said means for selectively expanding said support members comprises rotatable conical members mounted on the sides of a cart, said sides being pivotally mounted on the frame of said cart, said cart having power means for selectively advancing said conical members against said camming surfaces, whereby said support members are radially outwardly expanded as said conical members are further advanced against said camming surfaces.

* * * * *

UNITED STATES PATENT AND TRADEMARK OFFICE

CERTIFICATE OF CORRECTION

PATENT NO. : 4,296,891

DATED : October 27, 1981

INVENTOR(S) : H. John Sidaway and Maynard Good

It is certified that error appears in the above—identified patent and that said Letters Patent is hereby corrected as shown below:

In the patent heading, the data on the line identified as "[75] Inventors:" should read:

Abraham S. Birnbaum, Toledo, Ohio; James L. Fouss, Findlay, Ohio; Robert J. Della Flora, Bowling Green, Ohio; H. John Sidaway, Findlay, Ohio; Maynard Good, Elkhart, Indiana.

Also, under the words "United States Patent [19]", the inventor(s) should be identified as: Birnbaum et al Signed and Sealed this

*Second* Day of *February 1982*

[SEAL]

*Attest:*

GERALD J. MOSSINGHOFF

*Attesting Officer* *Commissioner of Patents and Trademarks*